United States Patent [19]

Ringgenberg et al.

[11] Patent Number: 4,693,316

[45] Date of Patent: Sep. 15, 1987

[54] ROUND MANDREL SLIP JOINT

[75] Inventors: Paul D. Ringgenberg; Daniel A. Newman; Harold K. Beck, all of Duncan, Okla.

[73] Assignee: Halliburton Company, Duncan, Okla.

[21] Appl. No.: 800,172

[22] Filed: Nov. 20, 1985

[51] Int. Cl.[4] ..... E21B 17/07

[52] U.S. Cl. ..... 166/355; 166/367; 175/321; 285/302

[58] Field of Search ..... 166/321, 330, 331, 355, 166/351, 367; 175/321; 285/302

[56] References Cited

U.S. PATENT DOCUMENTS

| | | | |
|---|---|---|---|
| 2,858,099 | 10/1958 | Althowe, Jr. et al. | 166/330 X |
| 3,354,950 | 11/1967 | Hyde | 166/367 X |
| 4,059,148 | 11/1977 | Blomsma | 166/321 X |

*Primary Examiner*—Stephen J. Novosad

*Attorney, Agent, or Firm*—Joseph A. Walkowski; Neal R. Kennedy

[57] ABSTRACT

A slip joint for use in a well string and having a removable torque transmitting key. The slip joint includes an outer female mandrel having a central opening therethrough in which is slidingly positioned a male mandrel, also defining a central opening therethrough. In one embodiment, the male mandrel defines at least one longitudinal slot therein and the female mandrel defines a transverse opening therethrough adjacent the slot. The torque transmitting key is positioned in the transverse opening and extends into the slot. In the second embodiment, the inner mandrel includes a flat surface thereon and the outer mandrel has a longitudinal slot therein adjacent the flat surface. The key includes a ring portion having a flat surface therein engageable with a flat surface on the male mandrel and a lug portion extending from the ring portion into the slot. Preferably, the slip joint also includes a bearing portion for radially positioning the inner mandrel and the outer mandrel and for guidance during axial movement therebetween. The bearing portion includes an annular sleeve bearing between the mandrels. In one embodiment, the key also includes a bearing surface in contact with the longitudinal slot for additional guidance between the mandrels.

12 Claims, 12 Drawing Figures

ROUND MANDREL SLIP JOINT

BACKGROUND OF THE INVENTION

1. Field of the Invention

This invention relates to slip joints for use in well strings, and more particularly, to a slip joint utilizing round mandrels and having removable key and bearing means.

2. Description of the Prior Art

Offshore wells with floating platforms present a problem in compensating for vertical movement of the platform. Without compensation, such vertical movement would transmit undesirable axial loads on a rigid well string extending downwardly from the platform. The solution has been to place at least one slip joint in the well string which compensates for the movement of the platform by axial telescoping action. A further problem is that such a slip joint must also be capable of transmitting torque so that a portion of the well string below the slip joint will be rotated concurrently with a portion of the well string above the slip joint.

A telescoping slip joint commonly used is of the type disclosed in U.S. Pat. No. 3,354,950 to Hyde. In the first embodiment disclosed in Hyde, an inner mandrel moves telescopingly within an outer mandrel. The inner mandrel defines a polygonal portion which extends into a corresponding polygonally shaped opening in the outer mandrel. The interaction of the polygonal surfaces provides a means for transmitting torque therebetween. It is necessary to seal between the mandrels so that fluid outside of the slip joint is not in communication with fluid passing through the well string. The problem with a slip joint using the polygonal configuration of Hyde is that the polygonal portion must be totally exposed or some method of sealing along the polygonal surface must be provided. Also, the polygonal portions are difficult and expensive to manufacture, and the entire apparatus must be dismantled for repair.

One solution to this problem is to provide a mandrel with only round surfaces, and one such slip joint is shown in an alternate embodiment in Hyde. However, even in the alternate embodiment of Hyde, which uses a key in a longitudinal keyway for transmitting torque, the key is not removable and major portions of the slip joint have to be replaced when repair becomes necessary.

The slip joint of the present invention solves these problems by having easily replaceable key means therein.

Another problem with slip joints of the prior art is that there is a possibility of radial loading on the sealing members therein which results in early failure. Also, internal parts are more likely to contact one another and wear in such a situation. The preferred embodiment of the present invention solves this problem by providing bearing means for precise location of the inner mandrel and for mutual guidance between the mandrels during relative axial motion thereof.

SUMMARY OF THE INVENTION

The slip joint of the present invention comprises first mandrel means defining a central opening longitudinally therethrough, second mandrel means also defining a central opening therethrough, key receiving means defined on said first and second mandrel means, and key means engageable with said key receiving means for transmitting torque between said first and second mandrel means and further providing guidance during relative movement thereof. The second mandrel means has a portion reciprocably positioned in the central opening of the first mandrel means such that the second mandrel means central opening and a portion of the first mandrel means central opening define a variable volume internal chamber therein. The key means is separable from both mandrel means.

The slip joint further comprises seal means between the first and second mandrel means for preventing fluid communication between the internal chamber and a well annulus.

Preferably, the slip joint also comprises first reservoir means in communication with the internal chamber, wherein the total volume of the first reservoir means and the internal chamber remains constant during relative movement of the first and second mandrel means, and additionally comprises second reservoir means in communication with the well annulus, wherein a total volume of the second reservoir means and the well annulus remains constant during relative movement of the first and second mandrel means. The seal means further prevents fluid communication between the first and second reservoir means.

In a preferred embodiment of the apparatus, the first mandrel means is characterized by an outer female mandrel portion in which a portion of the central opening therethrough defines an inner mandrel receiving cavity, and the second mandrel means is characterized by an inner male mandrel portion having a piston portion positionable in the inner mandrel receiving cavity. Bearing means are provided for centrally positioning the piston portion in the inner mandrel receiving cavity and for providing guidance of the mandrels during relative axial movement therebetween. The bearing means is adapted to minimize radial movement between the mandrels.

The outer mandrel defines a bearing cavity therein in which a sleeve bearing, forming a portion of the bearing means, is annularly positioned between the outer and inner mandrels.

The key means comprises torque transmission means for transmittal of torque from one mandrel to the other for mutual rotation thereof, and preferably, the torque transmission means also forms another portion of the bearing means.

In a preferred embodiment of the invention, the key receiving means comprises a portion of an outer surface of the second mandrel means defining a longitudinal slot therealong, and a portion of the first mandrel means defining a substantially transverse opening therein in communication with the central opening thereof and adjacent the slot. In this embodiment, the key means is characterized by a key positioned in the transverse opening and extending radially outwardly into the slot. The first mandrel means includes a collar portion defining an outermost surface of the transverse opening which is separable from another portion of the first mandrel means which defines radially extending surfaces of the transverse opening. The collar portion has an open position wherein the key may be installed and removed from the transverse opening without completely separating the first and second mandrel means.

In an alternate embodiment of the apparatus, the key receiving means comprises a surface of one of said first and second mandrel means defining a longitudinal slot therealong and key engaging means on the other of the mandrel means adjacent said slot, and the key means comprises a substantially annular ring portion engaged with the key engaging means and rotatable therewith and having a lug portion extending radially from the ring portion into the slot. The key engaging means is adapted for preventing longitudinal movement of the ring portion with respect to the key engaging means.

An important object of the invention is to provide a telescoping slip joint utilizing mandrels of substantially round cross section.

Another object of the invention is to provide a slip joint with a male mandrel inserted into a female mandrel with separable key means for transmission of torque between the mandrels.

A further object of the invention is to provide a slip joint having a first reservoir in communication with a central chamber defining a first constant total volume therebetween and a second reservoir in communication with a well annulus defining a second constant total volume therebetween.

Still another object of the invention is to provide a slip joint having key means which may be easily replaced without totally dismantling the apparatus or removing the slip joint from a well string to which it is attached.

An additional object of the invention is to provide a slip joint having bearing means for centrally positioning an inner mandrel in a central opening of an outer mandrel, minimizing radial movement therebetween, and providing guidance of the mandrels during relative axial movement therebetween.

A further object of the invention is to provide a slip joint having bearing means therein in which at least a portion of the bearing means also includes a key for transmission of torque between inner and outer mandrels of the slip joint.

Further objects and advantages of the invention will become apparent as the following detailed description of the preferred embodiment is read in conjunction with the accompanying drawings which illustrate such preferred embodiment.

BRIEF DESCRIPTION OF THE DRAWINGS

FIG. 6 shows an enlarged lower portion cross-sectional view of the preferred embodiment as indicated in FIG. 2.

DESCRIPTION OF THE PREFERRED EMBODIMENTS

Figure 1:
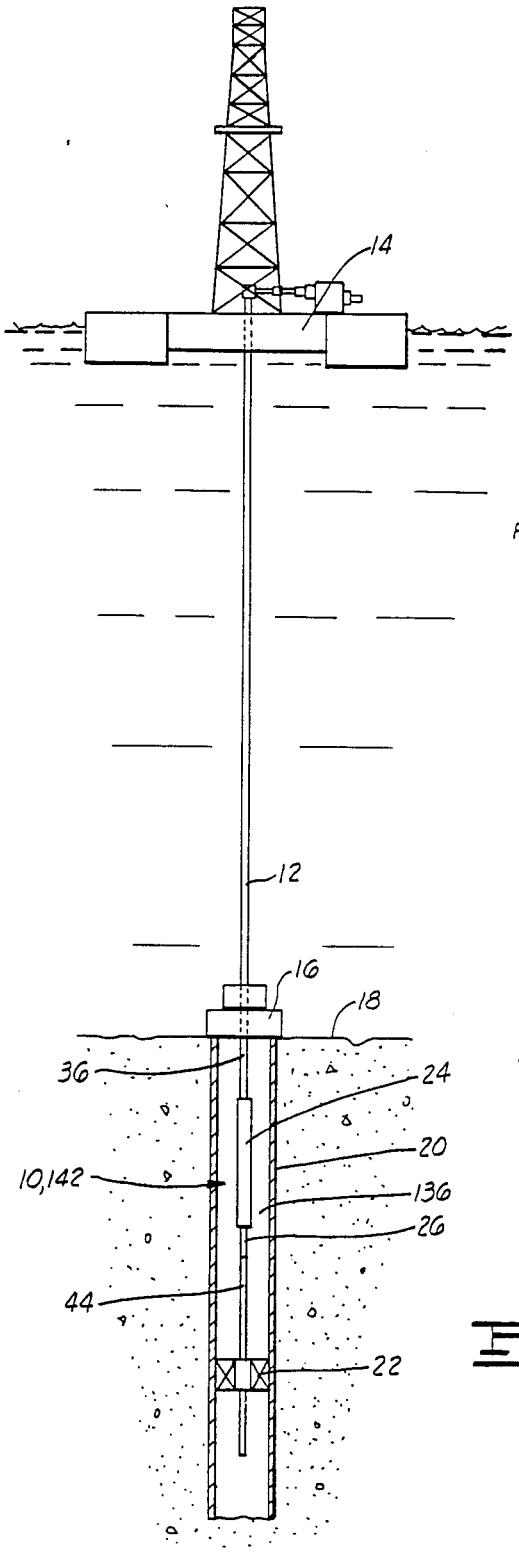
FIG. 1 shows the slip joint of the present invention in an operating position in a subsea well string.

Referring now to the drawings, and particularly FIG. 1, the slip joint of the present invention, generally designated by the numeral 10, is shown installed in an operating position in a well string 12. Well string 12 extends downwardly from a floating platform 14 through a subsurface well head at ocean floor 18 and into a well casing 20. A stationary tool such as packer 22 is located below slip joint 10. As will be hereinafter described, slip joint 10 provides telescoping means in the well string for compensating for vertical floating movement of platform 14 with respect to packer 22.

Figure 2:
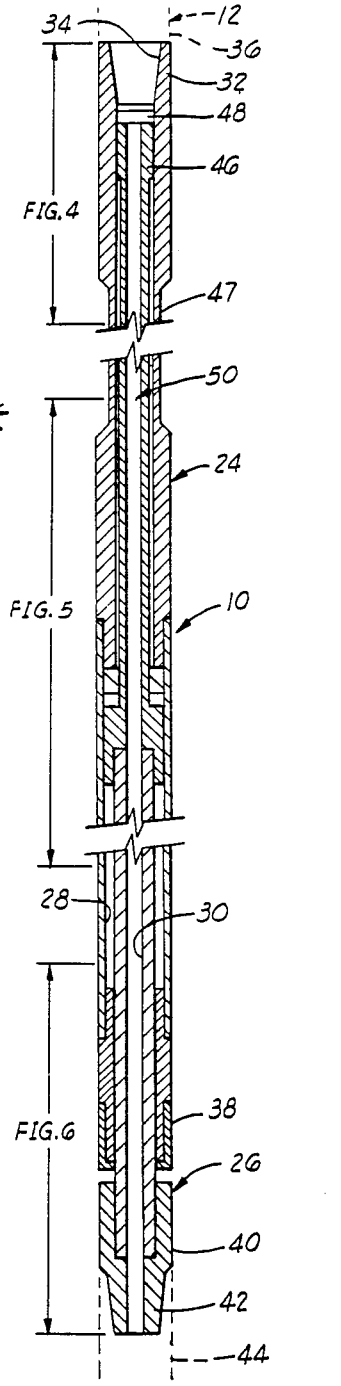
FIG. 2 illustrates the apparatus with the components of the slip joint in a converged position.
Figure 3:
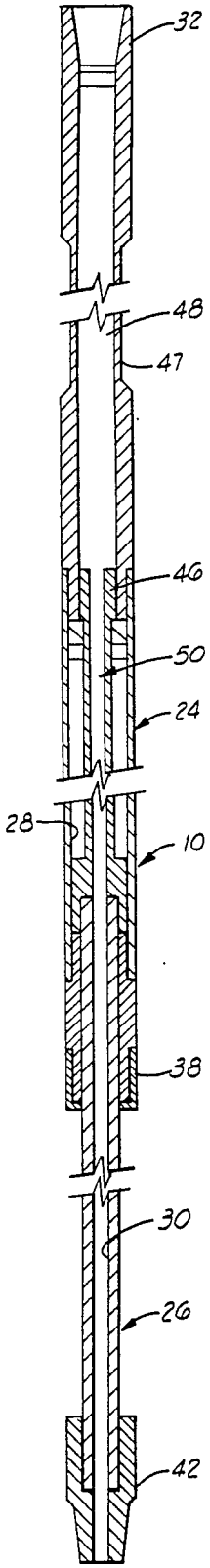
FIG. 3 is a general illustration of the apparatus in an extended position.

Referring now to FIGS. 2 and 3, slip joint 10 includes first mandrel means in the form of an outer female mandrel portion 24 and second mandrel means in the form of an inner male mandrel portion 26. Both mandrels are of substantially round cross section for ease of manufacture. This feature also provides a much better sliding sealing surface than a polygonal cross section, as discussed herein.

Female mandrel 24 defines a longitudinally or axially central opening 28 therethrough, and male mandrel 26 is reciprocably positioned in an inner mandrel receiving cavity portion of central opening 28 so that the mandrel portions may be axially moved relative to one another in a telescoping manner. Male mandrel 26 also defines a longitudinally or axially central opening 30 therethrough which is in communication with central opening 28 of female mandrel 24. FIG. 2 illustrates a relatively converged position of mandrels 24 and 26, and FIG. 3 shows a relatively extended position of the mandrels.

Female mandrel 24 includes a first, upper end 32 in communication with central opening 28 and having an internally threaded surface 34 adapted for attachment to an upper portion 36 of well string 12. Female mandrel 24 also has a second, lower end, opposite first end 32, which is also in communication with central opening 28.

Male mandrel 26 includes a first, lower end 40 in communication with central opening 30 and have an externally threaded surface 42 adapted for engagement with a lower portion 44 of well string 12. Male mandrel 26 also has a second, upper end 46 in communication with central opening 30, and thus further in communication with central opening 28 of female mandrel 24.

Surface 47 on the exterior of female mandrel 24 defines a built-in lifting sub which helps save time when making up well string 12.

When male mandrel 26 is in its reciprocating operating position in the inner mandrel receiving cavity of central opening 28 in female mandrel 24, lower end 40 of the male mandrel extends below lower end 38 of the female mandrel.

It will be clear to those skilled in the art that central opening 30 of male mandrel 26 and a variable upper portion 48 of central opening 28 of female mandrel 24 defined above upper end 46 of the male mandrel together generally define an elongated central chamber 50 inside slip joint 10 which is in fluid communication with upper portion 36 and lower portion 44 of well string 12.

It also will be seen that the volume of central chamber 50 varies with the relative position of female mandrel 24 and male mandrel 26.

Figure 4:
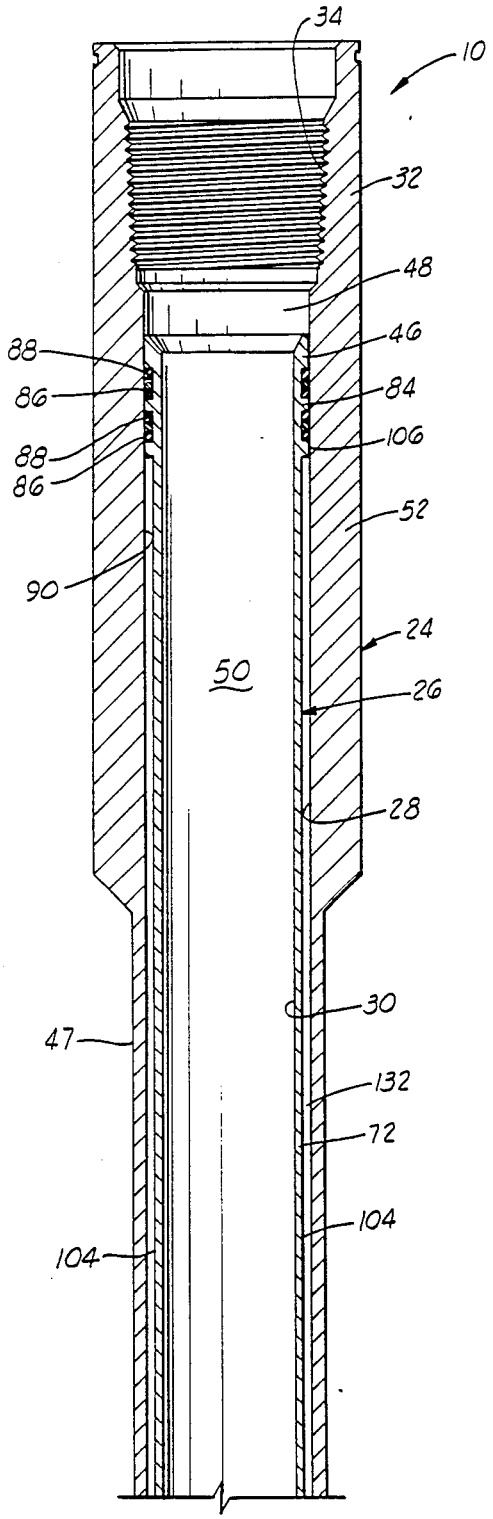
FIG. 4 is an enlarged cross-sectional view of an upper portion of a preferred embodiment as indicated in FIG. 2.
Figure 5:
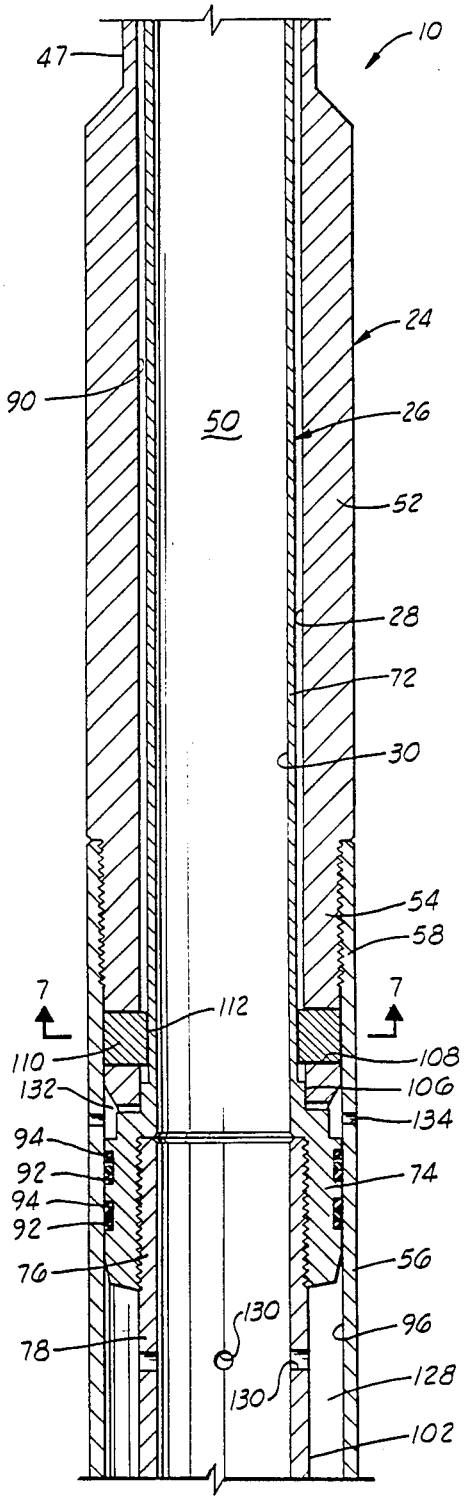
FIG. 5 is an enlarged intermediate portion cross section of the preferred embodiment as indicated in FIG. 2.

Referring now to FIGS. 4, 5 and 6, details of the construction of a preferred embodiment of slip joint 10 are shown. The portion of the slip joint represented by each of these figures is indicated in FIG. 2.

Female mandrel 24 includes an upper body 52 having an externally threaded lower sleeve portion 54. An intermediate collar 56 has an internally threaded upper end 58 engaged with sleeve 54 and an internally threaded lower portion 60. Female mandrel 24 also includes an adapter 62 having an upper externally threaded end engaged with lower portion 60 of intermediate collar 56. Adapter 62 further has a lower externally threaded end 66 which is threadingly engaged with a lower collar 68. A static seal 70 of a kind known in the art seals between lower end 60 of intermediate collar 56 and upper end 64 of adapter 62.

Male mandrel 26 includes an upper piston 72 threadingly engaged at a lower end 74 thereof with an upper end 76 of a plunger 78. A lower end 80 of plunger 78 is threadingly engaged with a collar 82 which generally defines lower end 40 of male mandrel 26.

At upper end 46 of male mandrel 26, an upper portion 84 of piston 72 defines at least one radially inwardly extending piston ring groove 86 therein. In the preferred embodiment, a plurality of grooves 86 are used. A seal 88 of a kind known in the art is disposed in each groove 86 for sliding, sealing engagement with internal surface 90 of body 52 of female mandrel 24. It will be seen that internal surface 90 defines a portion of central opening 28 of female mandrel 24.

Lower end 74 of piston 72 extends radially outwardly from central opening 90 at a lower end thereof, and lower end 74 defines at least one radially inward piston ring groove 92 therein, and preferably a plurality of such grooves. A seal 94 is disposed in each groove 92. Seals 94 are adapted for slidingly sealing inner surface 96 of intermediate collar 56, which also defines a portion of central opening 28 of female mandrel 24.

Lower end 66 of adapter 62 defines at least one radially outwardly extending ring groove 98 therein, and in the preferred embodiment, includes a plurality of such grooves. Disposed in each groove 98 is a seal 100 which is adapted for sliding, sealing contact with outer surface 102 of plunger 78.

Figure 7:
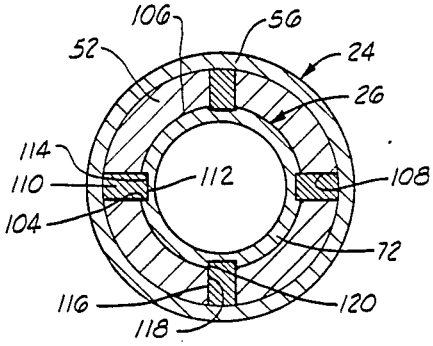
FIG. 7 is a transverse cross section taken along lines 7—7 in FIG. 5.

Referring now to FIGS. 4, 5 and 7, a plurality of radially outwardly facing keyways 104 are defined in outer surface 106 of piston 72, and extend longitudinally thereon between upper end 84 and lower end 74 thereof. Sleeve portion 54 of body 52 defines a plurality of transverse key receiving openings 108 therethrough, each opening being adjacent a corresponding keyway 104. Positioned in each transverse opening 108, and extending radially inwardly into adjacent keyway 104 is a key 110. Thus, openings 108 and keyways 104 act as key receiving means for keys 110. Intermediate collar 56 encloses each transverse opening 108 at the outermost end thereof, thus acting as a key retaining means for preventing radially outward movement of keys 110.

Each key 110 is dimensioned such that a radially inwardly facing side 112 thereof bears against a radially inner surface 114 of corresponding keyway 104. Key receiving openings 108 and keyways 104 are preferably equally angularly spaced so that keys 110 act to centrally locate piston 72 in body 52. In this way, radial contact between outer surface 106 of piston 52 and inner surface 90 of body 52 is eliminated or minimized, thus virtually eliminating uneven radial loading on seals 88 which results in an increased life thereof.

As shown in FIG. 7, tangentially facing sides 116 of keys 110 bear against corresponding tangentially facing sides 118 of transverse openings 108 and tangentially facing sides 120 of keyways 104. Thus, rotation of female mandrel 24 will transfer torque to male mandrel 26 for mutual rotation of the mandrels. In the preferred embodiment, keys 110 are made of a material such as brass which will fail due to shear force when the torque reaches a predetermined level. Keys 110 therefore include a preferred shear means so that torque is no longer transmitted between the mandrels and slip joint is thus not destroyed if an obstruction in well casing 20 acts to restrict rotation of male mandrel 26. Because body 52 may be easily disengaged from intermediate collar 56 to uncover key receiving openings 108, keys 110 are easily replaced when sheared or worn without totally dismantling the apparatus or detaching it from well string 12.

Figure 8:
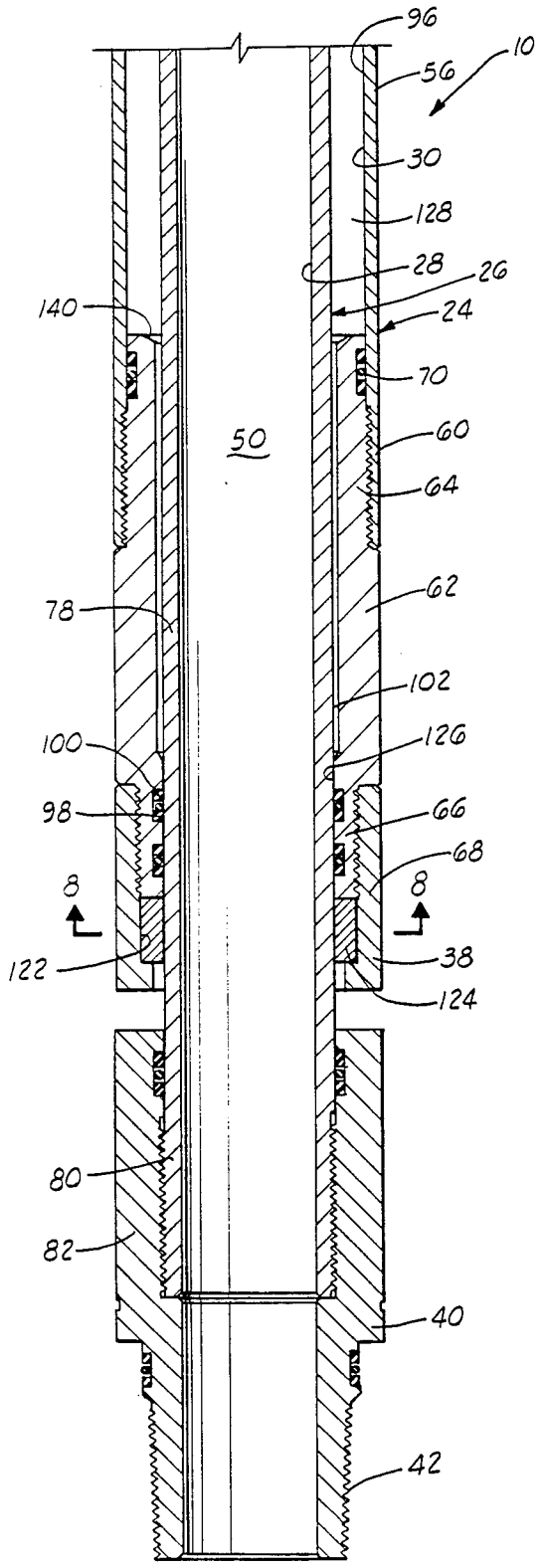
FIG. 8 is a transverse cross section taken along lines 8—8 in FIG. 6.

Referring now to FIGS. 6 and 8, lower collar 68 defines a bearing cavity 122 therein below and adjacent lower end 66 of adapter 62. An annular sleeve bearing 124 is positioned in cavity 122 and acts to guide and centrally locate outer surface 102 of plunger 78 within internal surface 126 of adapter 62. In this way, contact between outer surface 102 and inner surface 126 is substantially eliminated, as is radial loading on seals 100. Thus, wear is minimized and the life of seals 100 is extended.

It can be seen by those skilled in the art, therefore, that bearing 124 and keys 110 provide a bearing means for precise alignment and guidance of male mandrel 26 within female mandrel 24 during relative axial movement therebetween. It will also be obvious that radial loading on seals 94 is also virtually eliminated, thus increasing the life of those seals as well.

As shown in FIGS. 5 and 6, first reservoir means in the form of an internal first reservoir 128 is defined between plunger 78 of male mandrel 26 and intermediate collar 56 and adapter 62 portions of female mandrel 24. it will be seen by those skilled in the art that first reservoir 128 has a variable volume depending upon the longitudinal relative position of female mandrel 24 and male mandrel 26, and further that the first reservoir is sealingly enclosed by seals 94, 70 and 100.

At least one transverse hole 130, and preferably a plurality of such holes, is defined through plunger 78 such that first reservoir 128 is in fluid communication with central chamber 50. The inside diameter of surface 96 of intermediate collar 56 and the outside diameter of surface 102 of plunger 78 are sized such that they define an annular area therebetween which is equal to the area bounded by the inside diameter of surface 90 of body 52. A study by those skilled in the art will show that a total volume of central chamber 50 and first reservoir 128 is constant, regardless of the relative position of female mandrel 24 and male mandrel 26. Because liquids are substantially incompressible, this constant volume is important so that fluid pressure in well string 12 is not affected by vertical floating movement of platform 14.

Referring now to FIGS. 4 and 5, a second reservoir means, characterized by an internal second variable volume reservoir 132, is defined between piston 72 of male mandrel 26 and body 52 and intermediate collar 56 portions of female mandrel 24. It will be seen that second reservoir 132 is sealingly enclosed by seals 88 and 94 and that keyways 104 and key receiving openings 108 form a portion of the second reservoir. Therefore, keys 110 are located in second reservoir 132 and thus not in communication with the first reservoir.

At least one transverse hole 134 extends through intermediate collar 56 so that second reservoir 132 is in fluid communication with an annulus 136 defined between slip joint 10 and well casing 20. Annulus 136 is shown in FIG. 1. As female mandrel 24 and male mandrel 26 are moved relatively apart, an increasing portion of plunger 78 extends from lower end 38 of the female mandrel. The outside diameter of well string 12 and the outside diameter of outer surface 102 of plunger 78 are dimensioned such that the difference in cross-sectional area therebetween is equal to the annular area between internal surface 96 of intermediate collar 56 and outer surface 106 of piston 72. It will thus be seen by those skilled in the art that the total volume of well annulus 136 and second reservoir 132 is constant, regardless of the relative axial position of female mandrel 24 and male mandrel 26. Again, the constant volume is important to prevent undesired pressure changes in annulus 136 as a result of telescoping action of slip joint 10.

Sliding seals 88, 94 and 100, along with static seal 70 also prevent any fluid communication between well annulus 136 and central chamber 50. It will be seen that in the construction of slip joint 10, there are only round sealing surfaces which are much more positive and easier to manufacture than polygonal surfaces using wipers.

Maximum extension between the mandrels occurs when chamfered surface 138 on lower end 74 of piston 72 contacts chamfered surface 140 on adapter 62. As the mandrels are moved relatively apart to this extended position, fluid contained in first reservoir 128 is forced to flow through holes 130 into central chamber 50, and fluid in well annulus 136 flows into second reservoir 132 through hole 34. Reverse fluid flow occurs when the mandrels are moved toward the converged position shown in FIG. 2.

Figure 9:
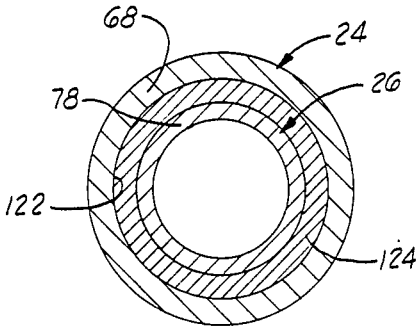
FIG. 9 is an enlarged cross section of an upper portion of an alternate embodiment, generally corresponding to FIG. 4.
Figure 9:
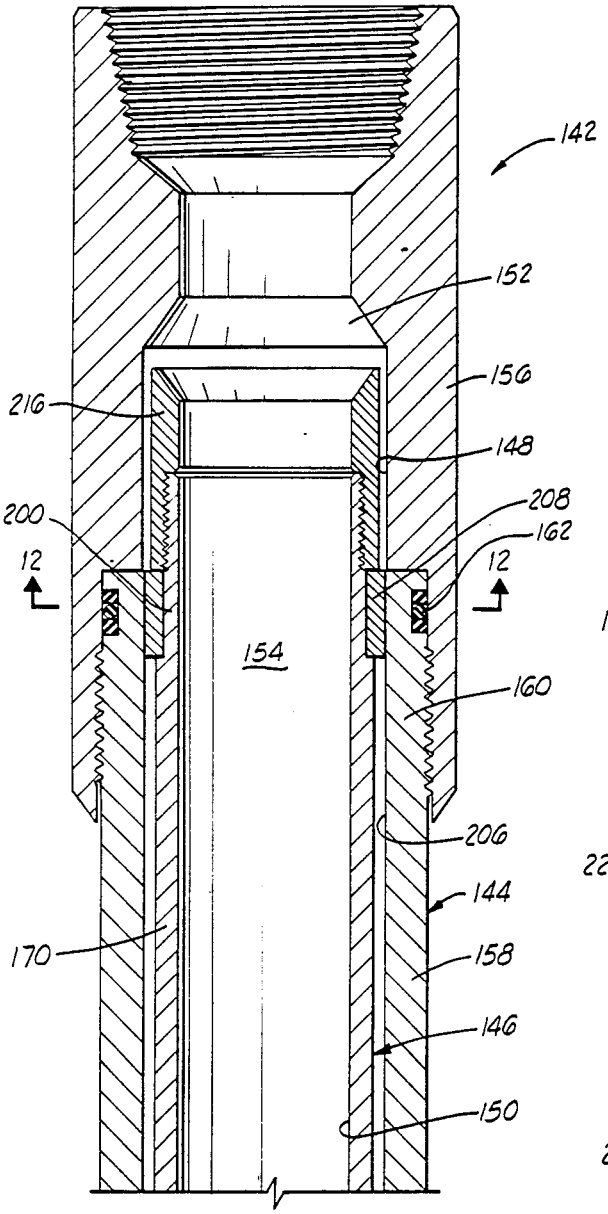
Figure 10:
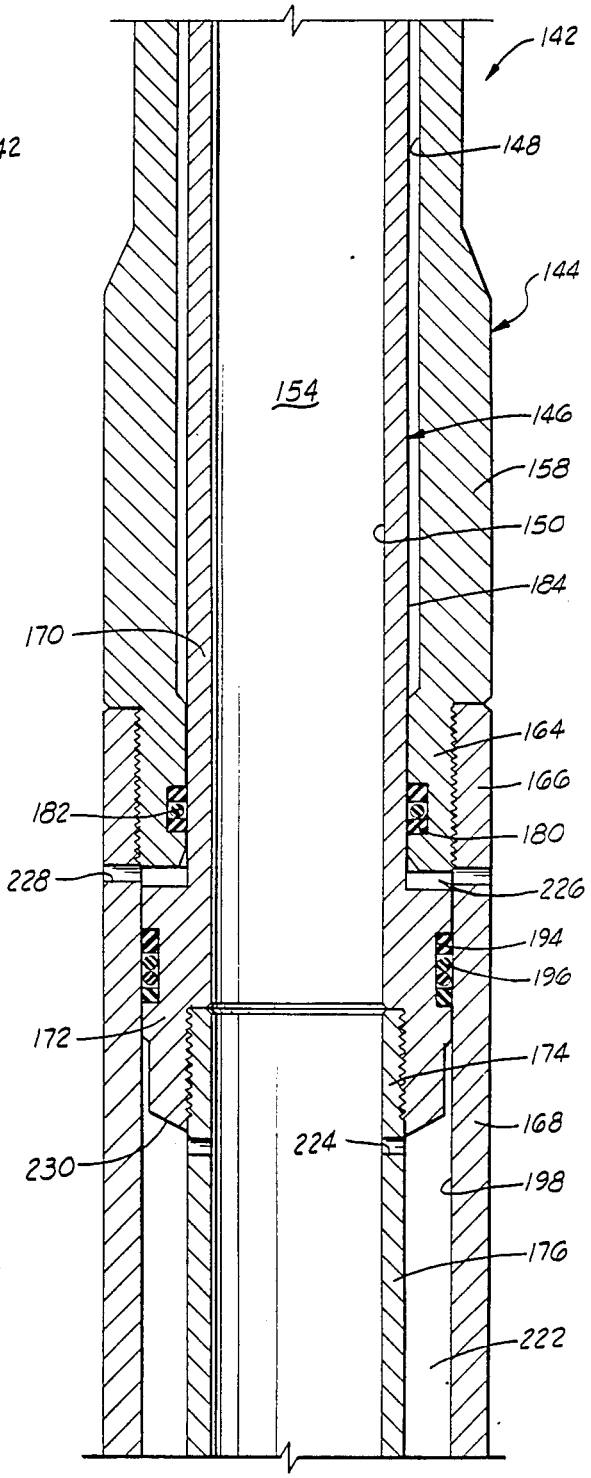
FIG. 10 is an enlarged intermediate portion cross section of the alternate embodiment, generally corresponding to FIG. 5.
Figure 11:
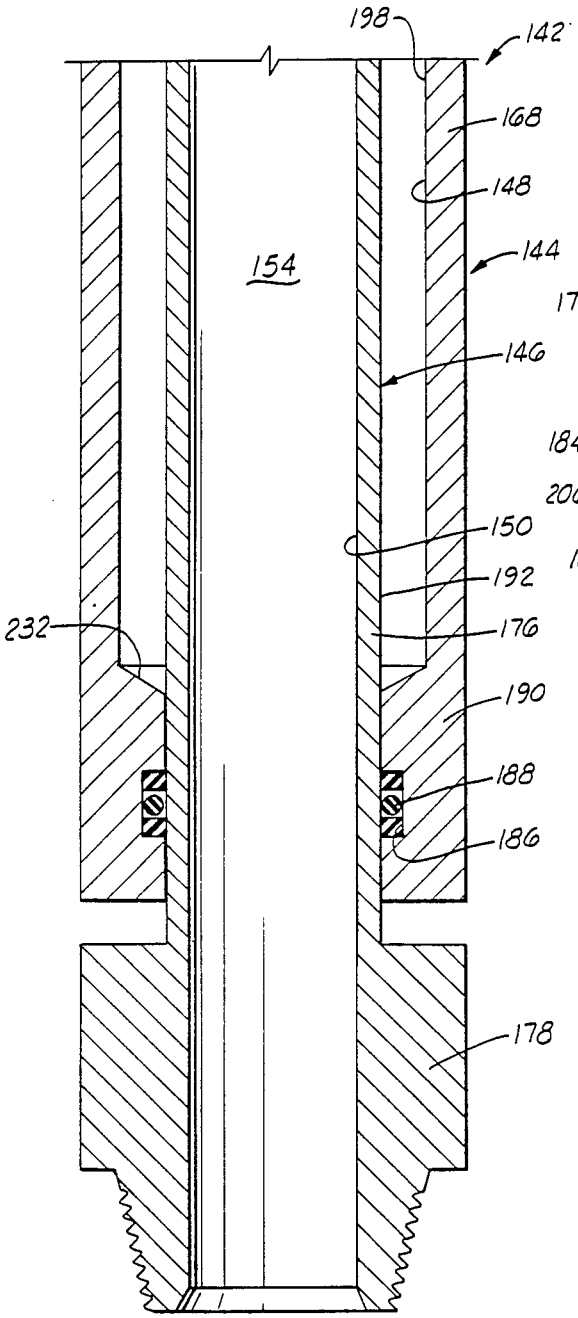
FIG. 11 shows an enlarged lower portion cross section of the alternate embodiment, generally corresponding to FIG. 6.

Referring now to FIGS. 9, 10 and 11, upper, intermediate and lower portions, respectively, of a second embodiment of the slip joint, generally designated by the numeral 142, are shown. Slip joint 142 again includes a female mandrel 144 with a male mandrel 146 reciprocably positioned in a central opening 148 of the female mandrel. Male mandrel 146 also defines a central opening 150 therethrough which together with an upper portion 152 of central opening 148 defines a longitudinally central chamber 154 in slip joint 142.

Female mandrel 144 includes an upper adapter 156 threadingly engageable with an upper portion 36 of well string 12 and a body 158 having an upper end 160 threadingly engaged with the adapter. A seal 162 provides means for sealing between body 158 and adapter 156. A lower end 164 of body 158 is threadingly engaged into an upper end 166 of a lower collar 168.

Male mandrel 146 includes an upper sleeve 170 having an enlarged lower end 172 threadingly engaged with an upper end 174 of a plunger 176. An enlarged lower end 178 of plunger 176 is adapted to be threadingly engaged with lower portion 44 of well string 12. Lower end 178 also forms the lowermost part of male mandrel 146 and extends downwardly from female mandrel 144.

Lower end 164 of body 158 defines a radially outwardly annular seal groove 180 therein. A seal 182 is disposed in groove 180 for sliding and sealing contact with outer surface 184 of sleeve 170. A similar groove 186 with a seal 188 disposed therein is located at lower end 190 of collar 168. Seal 188 is in sliding, sealing contact with outer surface 192 of plunger 176.

Enlarged lower portion 172 of sleeve 170 defines a radially inward groove 194 therein, in which is positioned a seal 196. Seal 196 is thus adapted for sliding, sealing contact with inner surface 198 of collar 168.

Figure 12:
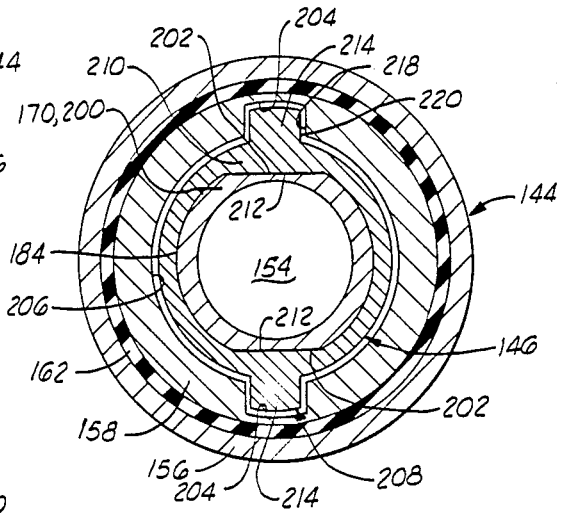
FIG. 12 is a transverse cross section taken along lines 12—12 in FIG. 9.

In FIGS. 9 and 12, it will be seen that an upper end 200 of sleeve 170 has a pair of opposed flat surfaces 202 formed in outer surface 184 thereof. A pair of keyways 204 extend radially outwardly from inner surface 206 of body 158, and each keyway is positioned adjacent a corresponding flat surface 202.

A key 208, having an annular ring portion 210, is positioned around upper portion 200 of sleeve 170. Ring portion 210 defines an internal surface with a pair of flat surfaces 212 therein corresponding to, and engageable with, flat surfaces 202. Extending radially outwardly from ring portion 210 of key 208 and into keyways 204 are a pair of opposed key lug portions 214.

A key retainer 216 is threadingly engaged with upper end 200 of sleeve 170 so that key 208 is longitudinally retained thereon and can be easily replaced when worn. It will be seen that, as female mandrel 144 is rotated, tangentially facing side 218 of keyway 204 contacts tangentially facing side 220 of key lug 214, thus transmitting torque from the female mandrel to sleeve 170 of the male mandrel. As with the first embodiment, the material of key 208 preferably has a shear strength such that the key will fail when the torque reaches a predetermined level, rather than other components of slip joint 142.

Referring now to FIGS. 10 and 11, plunger 176 and collar 168 define a first variable volume reservoir 222 therebetween which is sealingly enclosed by seals 196 and 188. Plunger 176 defines a transverse hole 224 therethrough so that first reservoir 222 and central chamber 154 are in fluid communication. As with the first embodiment, the components are sized such that the total volume of first reservoir 222 in central chamber 154 is constant, regardless of the relative axial position between female mandrel 144 and male mandrel 146.

Sleeve 170 and collar 168 define a second reservoir 226 therebetween which is sealingly enclosed by seals 182 and 196. Collar 168 has at least one transverse hole 228 therein such that second reservoir 226 and well annulus 136 are in fluid communication, in a manner similar to the first embodiment. Again, the components are dimensioned such that the total volume of reservoir 226 and well annulus 136 remains constant, regardless of the relative position of female mandrel 144 and male mandrel 146.

Maximum extension of slip joint 142 is determined when chamfered surface 230 on lower end 172 of sleeve 170 contacts chamfered surface 232 in lower end 190 of collar 168.

Thus, slip joint 142, the second embodiment of the apparatus of the present invention, also utilizes round mandrel construction for better sealing. Slip joint 142 further has removable key means for transmission of torque between the mandrels.

It is seen, therefore, that the slip joint of the present invention is well adapted to carry out the objects and attain the ends and advantages mentioned, as well as those inherent therein. While two presently preferred embodiments of the invention have been described for the purposes of this disclosure, numerous changes in the construction and arrangement of parts can be made by those skilled in the art. All such changes are encompassed within the scope and spirit of this invention as defined by the appended claims.

What is claimed is:

1. A slip joint for use in a well string, said slip joint comprising:

first mandrel means defining a central opening longitudinally therethrough;

second mandrel means defining a central opening therethrough and having a portion reciprocably positioned in said central opening of said first mandrel means such that said second mandrel means central opening and a portion of said first mandrel means central opening define a variable volume internal chamber;

key receiving means defined on both said first and second mandrel means, said key receiving means comprising in part a surface of one of said first and second mandrel means defining a longitudinal slot therealong and in part key engaging means on the other of said first and second mandrel means and adjacent said slot defined on said one of said first and second mandrel means; and key means engageable with said key receiving means for transmitting torque between said first and second mandrel means and providing guidance during relative movement thereof, said key means being separable from said first and second mandrel means, and comprising a substantially annular ring portion engaged with said key engaging means and rotatable therewith and a lug portion extending radially from said ring portion and into said slot.

2. The slip joint of claim 1 further comprising seal means between said first and second mandrel means for preventing fluid communication between said internal chamber and a well annulus.

3. The slip joint of claim 2 further comprising:

first reservoir means in communication with said internal chamber, wherein a total volume of said first reservoir means and said internal chamber remains constant during said relative movement of said first and second mandrel means; and second reservoir means in communication with said well annulus, wherein a total volume of said second reservoir means and said well annulus remains constant during said relative movement of said first and second mandrel means;

wherein, said seal means further prevents fluid communication between said first and second reservoir means.

4. The slip joint of claim 2 wherein said seal means further prevents communication between said key receiving means and said internal chamber.

5. An apparatus for providing relative movement between portions of a well string positioned in a well bore, said apparatus comprising:

a female mandrel comprising:

an internal surface defining a central opening axially therethrough and a plurality of angularly spaced key receiving cavities extending radially outwardly from said central opening at an axially intermediate location thereealong;

a first end adapted for attachment to one of said well string portions and in communication with said central opening; and a second end opposite said first end and in communication with said central opening;

a male mandrel reciprocably positioned in said female mandrel central opening, said male mandrel comprising:

an internal surface defining a central opening axially therethrough, said male mandrel central opening and a portion of said female mandrel central opening adjacent said male mandrel forming an elongated central chamber;

a first end adapted for attachment to another of said well string portions, extending from said female mandrel second end, and in communication with said male mandrel central opening;

a second end opposite said male mandrel first end and in communication with said male and female mandrels central openings; and an outer surface, a portion of which defining a plurality of angularly spaced keyways therein and alignable with said key receiving cavities;

a plurality of keys, each key positioned in one of said key receiving cavities, extending radially inwardly into a corresponding keyway, and bearing against a radially inner portion thereof for centrally positioning said male mandrel in said female mandrel central opening, such that as torque is applied to one of said mandrels, said torque is transmitted to the other of said mandrels; and sealing means disposed between said male mandrel outer surface and said female mandrel inner surface for sealing therebetween, such that fluid communication between said central chamber and said keyways is prevented.

6. The apparatus of claim 5 wherein a collar portion of said female mandrel inner surface, defining an outermost surface of each of said key receiving cavities, is separable from a sleeve portion of said female mandrel which defines radially extending surfaces of each of said key receving cavities, said collar portion having an open position wherein said keys may be installed and removed from said cavities without removing said male mandrel from said female mandrel central opening.

7. The apparatus of claim 5 wherein said sealing means comprises:

a first seal adjacent said second end of said female mandrel;

a second seal adjacent said second end of said male mandrel; and a third seal positioned between said first and second seals.

8. The apparatus of claim 7 wherein said female mandrel inner surface and said male mandrel outer surface together define:

a first reservoir bounded by said first and third seals and in communication with said central chamber; and a second reservoir bounded by said second and third seals in communication with a well annulus;

wherein, said seals further prevent fluid communication between said first and second reservoirs.

9. The apparatus of claim 8 wherein:

said first reservoir and said central chamber have a constant total fluid volume during relative movement of said male and female mandrels; and said second reservoir and said well annulus have a constant fluid volume during relative movement of said male and female mandrels.

10. The apparatus of claim 8 wherein said key receiving cavities and keyways are disposed in said second reservoir.

11. The apparatus of claim 5 wherein said female mandrel inner surface further defines a bearing cavity therein, axially spaced from said key receiving cavities, and further comprising a bearing disposed in said bearing cavity for radially positioning said male mandrel in said female mandrel central opening and for mutual guidance between said mandrels.

12. The apparatus of claim 11 wherein said sealing means further prevents fluid communication between said bearing receiving cavity and said central chamber.

* * * * *